US009738096B2

(12) United States Patent
Mimoto

(10) Patent No.: US 9,738,096 B2
(45) Date of Patent: Aug. 22, 2017

(54) IMAGE RECORDING APPARATUS

(71) Applicant: BROTHER KOGYO KABUSHIKI KAISHA, Nagoya-shi, Aichi-ken (JP)

(72) Inventor: Masao Mimoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/478,019

(22) Filed: Sep. 5, 2014

(65) Prior Publication Data

US 2015/0070455 A1 Mar. 12, 2015

(30) Foreign Application Priority Data

Sep. 6, 2013 (JP) ..... 2013-185447

(51) Int. Cl.
*B41J 11/02* (2006.01)
*B41J 11/00* (2006.01)

(52) U.S. Cl.
CPC ..... *B41J 11/0045* (2013.01); *B41J 11/0095* (2013.01)

(58) Field of Classification Search
USPC ..... 347/16; 271/3.2
See application file for complete search history.

(56) References Cited

U.S. PATENT DOCUMENTS 5,527,123 A * 6/1996 Jackson ..... B41J 13/14 271/209
5,580,042 A * 12/1996 Taniguro ..... B41J 11/005 271/274
5,897,259 A * 4/1999 Ahn ..... B41J 13/14 271/109
6,131,899 A * 10/2000 Nojima ..... B65H 3/66 271/121
6,152,631 A * 11/2000 Park ..... B41J 13/103 271/10.03
6,293,669 B1 * 9/2001 Uchida ..... B41J 13/106 347/104
6,409,043 B1 * 6/2002 Fujita ..... B65H 5/24 271/10.03
6,874,778 B2 * 4/2005 Nakano ..... B65H 7/20 271/111

(Continued)

FOREIGN PATENT DOCUMENTS

JP 2005-144931 A 6/2005

*Primary Examiner* — Matthew Luu
*Assistant Examiner* — Lily Kemathe
(74) *Attorney, Agent, or Firm* — Merchant & Gould P.C.

(57) ABSTRACT

An image recording apparatus includes: a roller pair for conveying a sheet in a conveying direction along a conveyance path; a head for ejecting liquid; a platen opposite the head; contact portions, spaced apart from each other in a widthwise direction and opposite the platen, for contacting the sheet between the roller pair and nozzles of the head; first and second guide members disposed upstream of the roller pair in the conveying direction and disposed in the conveyance path nearer to the head and the platen, respectively; a rotatable lever including an arm protruding from the first guide member toward the second guide member into the conveyance path; and a sensor for detecting rotation of the lever. The arm in the widthwise direction overlaps at least one of the contact portions.

13 Claims, 11 Drawing Sheets

(56) References Cited

U.S. PATENT DOCUMENTS

| | | | | |
|---|---|---|---|---|
| 7,187,901 | B2 * | 3/2007 | Ohashi | B41J 13/0063 399/381 |
| 7,192,207 | B2 * | 3/2007 | Ohashi | B41J 3/60 347/8 |
| 7,618,140 | B2 * | 11/2009 | Kato | 347/104 |
| 8,424,870 | B2 * | 4/2013 | Van Soest | B41J 11/425 271/207 |
| 8,625,173 | B2 * | 1/2014 | Asada et al. | 358/498 |
| 8,789,940 | B2 * | 7/2014 | Kawamata | 347/104 |
| 2005/0047840 | A1 * | 3/2005 | Ohashi | B41J 13/0063 399/388 |
| 2012/0081760 | A1 * | 4/2012 | Asada et al. | 358/471 |
| 2012/0134733 | A1 * | 5/2012 | Ota et al. | 400/611 |
| 2012/0162302 | A1 * | 6/2012 | Oguchi et al. | 347/16 |
| 2013/0135413 | A1 * | 5/2013 | Ito et al. | 347/104 |
| 2014/0232054 | A1 * | 8/2014 | Ota et al. | 271/3.2 |

* cited by examiner

IMAGE RECORDING APPARATUS

CROSS REFERENCE TO RELATED APPLICATION

The present application claims priority from Japanese Patent Application No. 2013-185447, which was filed on Sep. 6, 2013, the disclosure of which is herein incorporated by reference in its entirety.

BACKGROUND

Technical Field

The present invention relates to an image recording apparatus configured to record an image on a sheet.

Description of the Related Art

There is conventionally known an ink jet recording apparatus configured to eject ink to record an image on a sheet. In order to detect positions of leading and trailing edges of the sheet, some ink jet recording apparatuses are provided with an actuator and an optical sensor. The actuator is turned by contact with the sheet and disposed upstream of a recording head in a sheet conveying direction, and the optical sensor senses the turn of the actuator.

SUMMARY

However, in a case where a roller pair is provided upstream of the recording head, if the actuator is provided in an upper portion of a conveyance path like the recording head, the sheet may be pushed downward by the actuator, whereby a portion of the sheet which is located downstream of the roller pair in the sheet conveying direction may be floated up from a platen, with the roller pair serving as a fulcrum. As a result, the sheet may be brought into contact with the recording head, which may soil the sheet and/or cause a jam of the sheet.

This invention has been developed to provide a technique preventing a sheet from floating up from a platen even in a construction in which a detecting lever for sensing the sheet is disposed in a head-side portion of a conveying path.

The present invention provides an image recording apparatus, including: a roller pair configured to nip and convey a sheet in a conveying direction along a conveyance path; a recording head including a plurality of nozzles and configured to eject liquid from the plurality of nozzles; a platen disposed opposite the recording head and configured to support the sheet conveyed by the roller pair; a plurality of first contact portions opposed to the platen so as to contact the sheet at a position between, in the conveying direction, a nip position of the roller pair at which the roller pair nips the sheet and a position at which the plurality of nozzles are formed in the recording head, the plurality of first contact portions being spaced apart from each other in a widthwise direction which intersects the conveying direction; a first guide member disposed upstream of the nip position of the roller pair in the conveying direction and disposed on a recording-head side of the conveyance path to define at least a portion of one of opposite areas of the conveyance path; a second guide member disposed upstream of the nip position of the roller pair in the conveying direction and disposed on a platen side of the conveyance path to define at least a portion of another of the opposite areas of the conveyance path; a detecting lever provided rotatably and including an arm protruding from the first guide member toward the second guide member into the conveyance path; and a sensor configured to detect rotation of the detecting lever. A position of the arm in the widthwise direction overlaps a position of at least one of the plurality of first contact portions.

The present invention also provides an image recording apparatus, including: a roller pair configured to nip and convey a sheet in a conveying direction along a conveyance path; a recording head including a plurality of nozzles and configured to eject liquid from the plurality of nozzles onto the sheet conveyed by the roller pair; a platen disposed opposite the recording head and configured to support the sheet conveyed by the roller pair; a plurality of first contact portions opposed to the platen so as to contact the sheet at a position between, in the conveying direction, a nip position of the roller pair at which the roller pair nips the sheet and a position at which the plurality of nozzles are formed in the recording head, the plurality of first contact portions being spaced apart from each other in a widthwise direction which intersects the conveying direction; a detecting lever provided rotatably and including an arm protruding from a recording-head side of the conveyance path toward a platen side of the conveyance path into the conveyance path; and a sensor configured to detect rotation of the detecting lever. A position of the arm in the widthwise direction overlaps a position of at least one of the plurality of first contact portions.

The sheet conveyed in the conveyance path in the conveying direction is brought into contact with the arm of the detecting lever between the first guide member and the second guide member to turn the arm. This turn of the arm is sensed by the sensor. The sheet conveyed onto the platen by the roller pair is corrugated in the main scanning direction by the first contact portions. Since the position of the arm of the detecting lever in the main scanning direction overlaps the position of the at least one of the first contact portions, the sheet does not float up from the platen.

EFFECTS

In the present invention, even in a construction in which a detecting lever for sensing a sheet is disposed in a head-side portion of a sheet conveyance path, the sheet does not float up from a platen.

DETAILED DESCRIPTION OF THE EMBODIMENT

Hereinafter, there will be described one embodiment of the present invention by reference to the drawings. It is to be understood that the following embodiment is described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is viewed from the front side.

Overall Configuration of MFP 10

Figure 1:
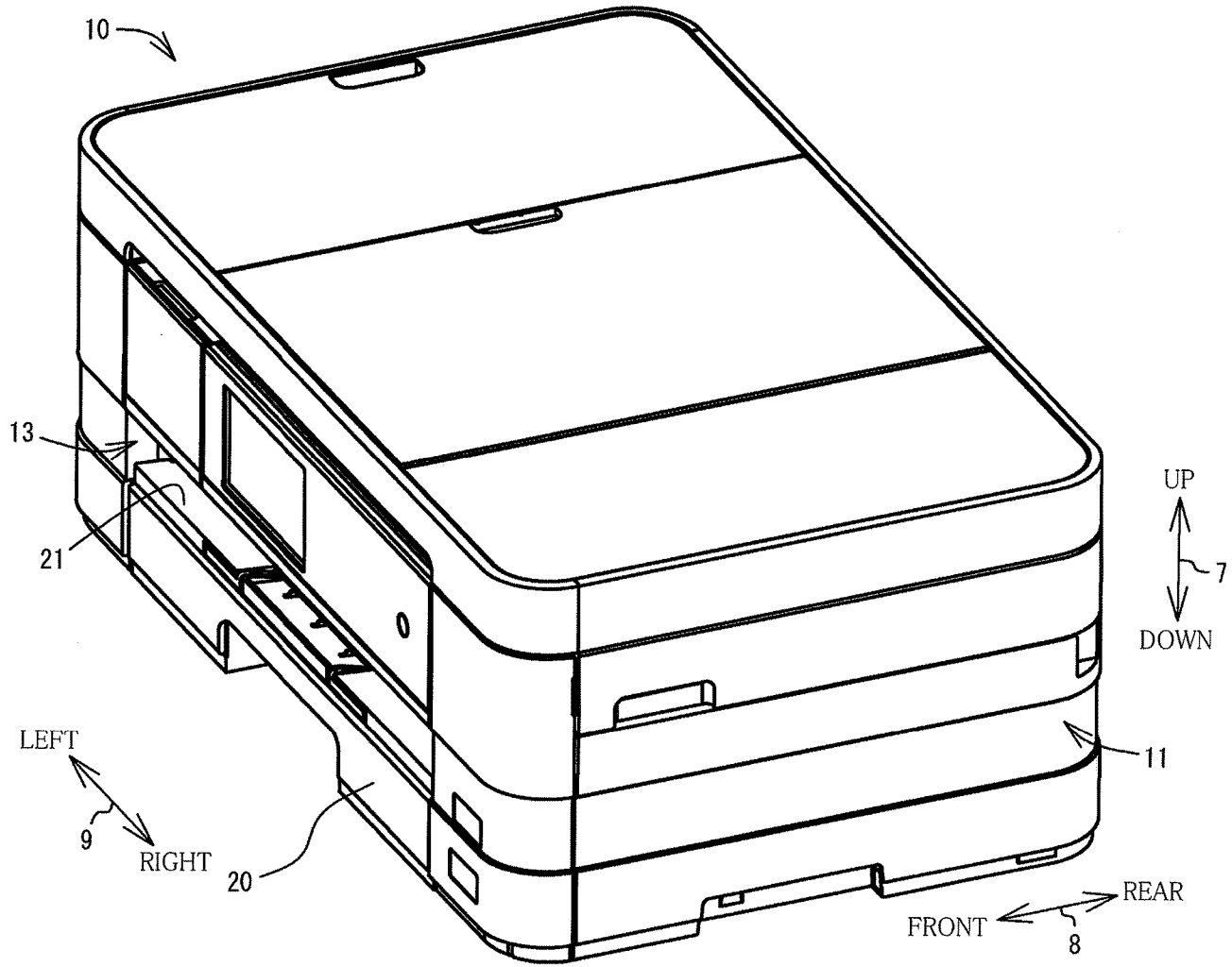
FIG. 1 is an external perspective view illustrating a multi-function peripheral (MFP)

As illustrated in FIG. 1, the MFP 10 has generally a rectangular parallelepiped shape. The MFP 10 includes, at its lower portion, a printing section 11 configured to record an image on, e.g., a sheet 12 (see FIG. 2) and, at its upper portion, a scanning section 14 configured to read or scan an image on a document. The MFP 10 has various functions such as a printing function, a scanning function, and a facsimile function. It is noted that the present description omits detailed explanations of the construction of the scanning section 14, the scanning function, and the facsimile function.

Supply Tray 20 and Output Tray 21

Figure 2:
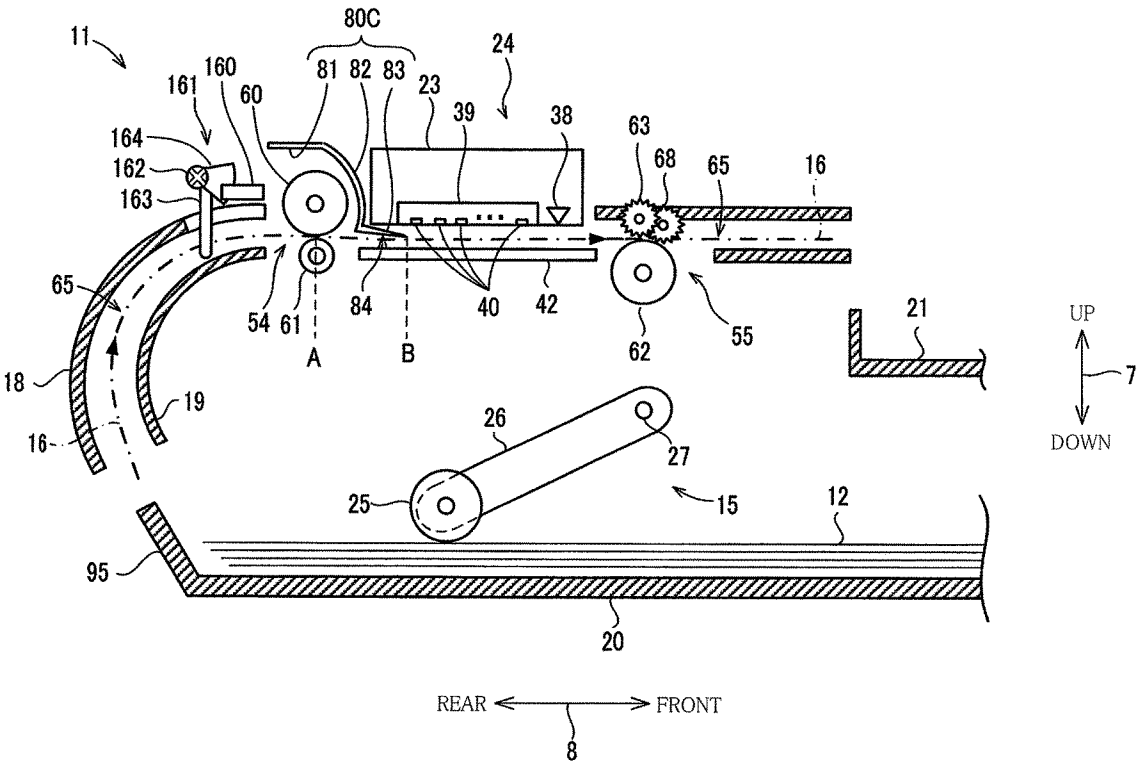
FIG. 2 is an elevational view in vertical cross section schematically illustrating an internal structure of a printing section.

As illustrated in FIG. 2, a supply tray 20 is disposed at a lowermost portion of the printing section 11. The supply tray 20 can be inserted into and removed from a housing of the MFP 10 in the front and rear direction 8 through the opening 13 formed in a front face of the printing section 11. The supply tray 20 can support a plurality of sheets 12 stacked on one another. An output tray 21 is disposed on an upper side of the supply tray 20. The output tray 21 can support the sheet P discharged from a conveyance path 65.

Figure 3:
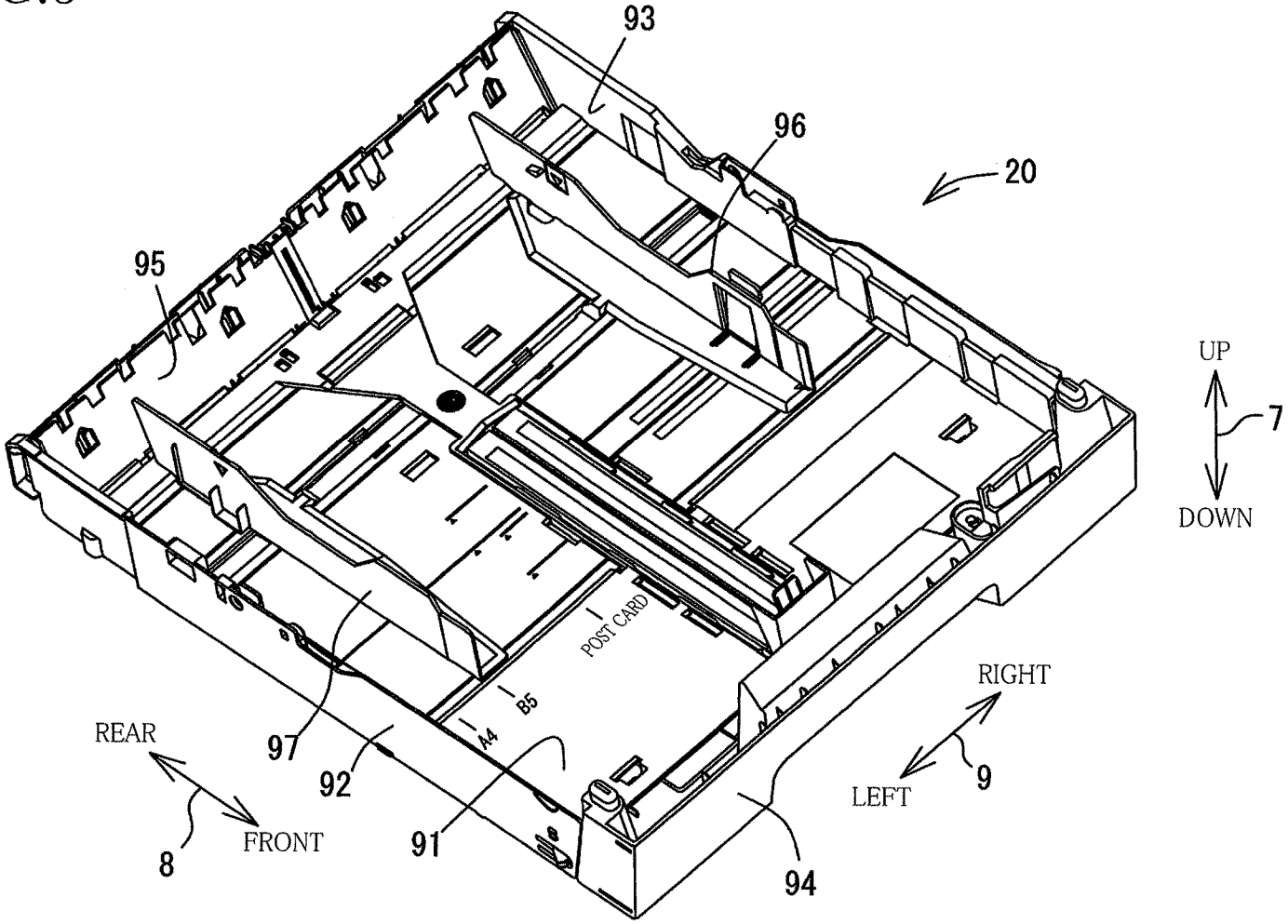
FIG. 3 is a perspective view illustrating a supply tray.

As illustrated in FIG. 3, the supply tray 20 is shaped like a box whose upper side is open. The supply tray 20 includes a bottom plate 91, a left side plate 92, a right side plate 93, a front plate 94, and an inclined plate 95. The left side plate 92 and the right side plate 93 stands on opposite edge portions of the bottom plate 91 in the right and left direction 9. The front plate 94 stands on a front edge portion of the bottom plate 91 in the front and rear direction 8. The output tray 21 is supported by the left side plate 92, the right side plate 93, and the front plate 94 (see FIG. 1). The inclined plate 95 extends obliquely upward in the rear direction from a rear edge of the bottom plate 91 in the front and rear direction 8 to guide the sheet 12 supplied from a supply portion 15, to the conveyance path 65.

The bottom plate 91 can support sheets 12 of a plurality of standard sizes such as the A4 size, the B5 size, the legal size, and the postcard size. The bottom plate 91 has marks each indicating a position of one of edge portions (a left edge portion in the example in FIG. 3) of the sheet 12 of a corresponding one of the various standard sizes in the right and left direction 9. It should be understood that FIG. 3 illustrates "A4", "B5", and "Postcard" as examples of the mark, but other marks may be used.

The bottom plate 91 is provided with guide members 96, 97 for positioning the sheet or sheets 12 placed on the bottom plate 91 by contacting opposite edges of the sheet(s) 12 in the right and left direction 9. The guide members 96, 97 use center alignment to prevent skew of the sheet 12 and to position the various standard sizes of the sheets 12 placed on the bottom plate 91. The center alignment is an operation for aligning a center of each sheet 12 supported on the bottom plate 91 in the right and left direction 9 to a center of the bottom plate 91 in the right and left direction 9.

A user places the sheet(s) 12 on the bottom plate 91 such that the center of each sheet 12 is aligned to a center line of the bottom plate 91 in the right and left direction 9. The user then slides the guide member 96 in the left direction of the right and left direction 9 to a position indicated by the mark corresponding to the size of the sheet(s) 12, so that the guide member 96 is brought into contact with a right edge of the sheet(s) 12. The guide member 97 is slid in the right direction by a pinion gear, not shown, in conjunction with the guide member 96 and brought into contact with a left edge of the sheet(s) 12. The sheet or sheets 12 of the various standard sizes placed on the bottom plate 91 are thus positioned by the guide members 96, 97 using the center alignment.

Supply Portion 15

As illustrated in FIG. 2, the supply portion 15 is provided on an upper side of the supply tray 20 mounted in the printing section 11. The supply portion 15 includes a supply roller 25, a supply arm 26, and a shaft 27. The supply roller 25 is rotatably provided at a distal end portion of the supply arm 26. The supply roller 25 is rotated by drive power transmitted from a conveying motor 102 (see FIG. 10). The supply arm 26 is pivotably supported on the shaft 27 supported by a frame 41 of the printing section 11. The supply arm 26 urged toward the supply tray 20 by its own weight or an elastic force generated by a spring, for example. The supply roller 25 is rotated in a state in which the supply roller 25 is held in contact with an uppermost one of the sheets 12 supported on the supply tray 20, so that the uppermost sheet 12 is conveyed into the conveyance path 65 by the supply roller 25.

Conveyance Path 65

As illustrated in FIG. 2, the conveyance path 65 is defined in the printing section 11 partly by an outer guide member 18 and an inner guide member 19 which are opposite each other at a predetermined distance. The conveyance path 65 extends from a rear edge portion of the supply tray 20 to a rear portion of the printing section 11, then makes an upward U-turn from a lower portion in the rear portion of the printing section 11 so as to extend toward a front portion of the printing section 11, and extends to the output tray 21 via a recording device 24. The conveyance path 65 extends to the output tray 21 via a nipping position of a conveying roller portion 54 (at which the sheet 12 is nipped by the conveying roller portion 54), a position between a platen 42 and a recording head 39, and a nipping position of an output roller portion 55 (at which the sheet 12 is nipped by the output roller portion 55). In FIG. 2, a sheet conveying direction 16 in the conveyance path 65 is indicated by the one-dot chain line arrow.

The outer guide member 18 and the inner guide member 19 are disposed in the rear portion of the printing section 11 at an area in which the conveyance path 65 is curved such that the conveying direction 16 is also curved like a U-turn. The outer guide member 18 is disposed outside the curved conveyance path 65, and the inner guide member 19 is inside the curved conveyance path 65. The outer guide member 18 and the inner guide member 19 define a portion of the conveyance path 65 which is located upstream of the conveying roller portion 54 in the conveying direction 16. The outer guide member 18 is one example of a first guide member, and the inner guide member 19 is one example of a second guide member.

Conveying Roller Portion 54 and Output Roller Portion 55

As illustrated in FIG. 2, the conveying roller portion 54 is disposed in the conveyance path 65 at a position located downstream of the supply portion 15 in the conveying direction 16 and upstream of the recording device 24 in the conveying direction 16. The conveying roller portion 54 includes a conveying roller 60 rotated by the conveying motor 102 and pinch rollers 61 rotated by the rotation of the conveying roller 60. The conveying roller 60 and the pinch rollers 61 nip and convey the sheet 12 in the conveying direction 16. The conveying roller 60 and the pinch rollers 61 are one example of a roller pair.

The output roller portion 55 is provided in the conveyance path 65 at a position located downstream of the recording device 24 in the conveying direction 16. The output roller portion 55 includes an output roller 62 rotated by the conveying motor 102 and spurs 63 rotated by the rotation of the output roller 62. The output roller 62 and the spurs 63 nip and convey the sheet 12 in the conveying direction 16.

Platen 42

Figure 4:
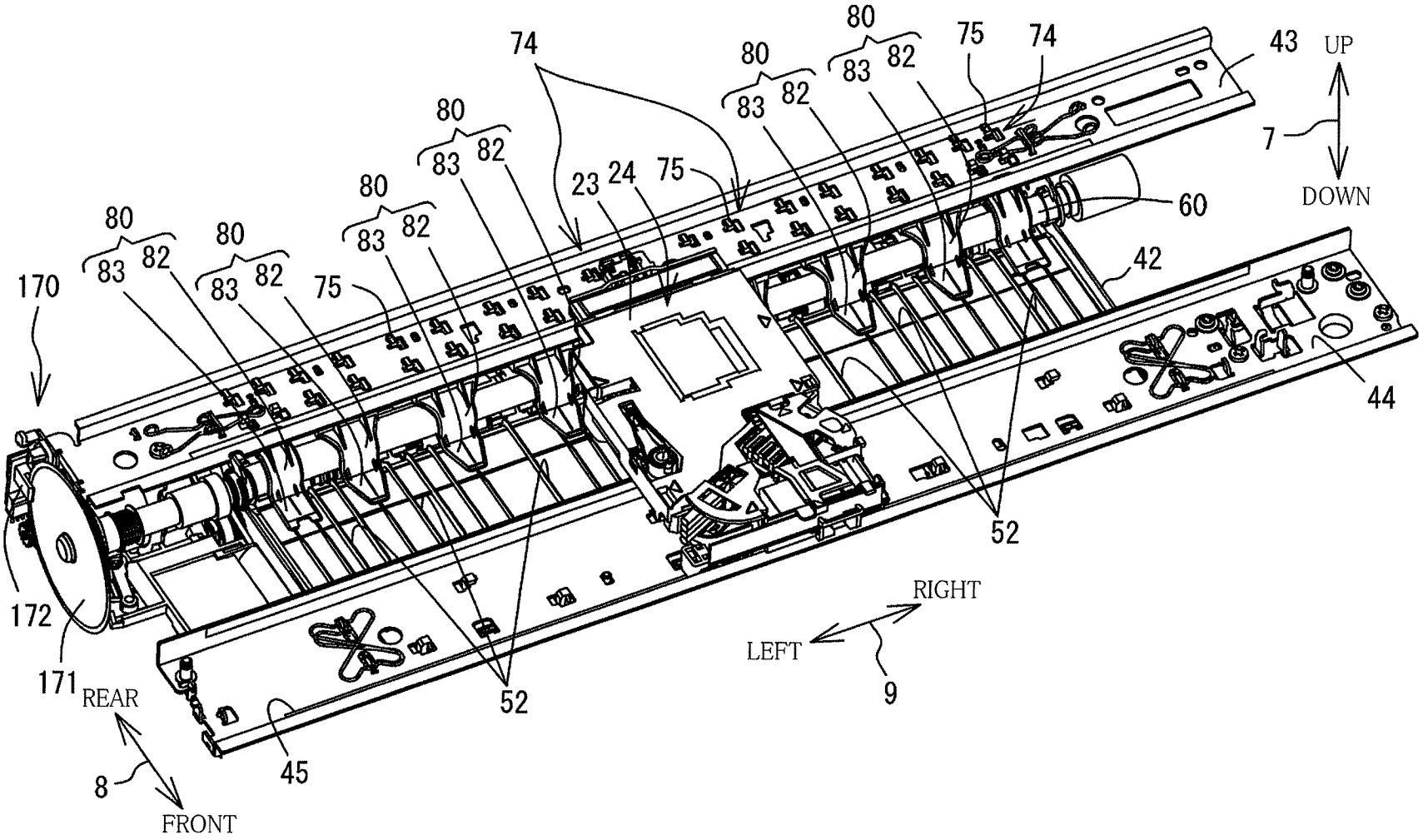
FIG. 4 is a perspective view illustrating a recording device supported on a guide rail.

As illustrated in FIGS. 2 and 4, the platen 42 is provided in a lower portion of the conveyance path 65 at a position located between the conveying roller portion 54 and the output roller portion 55 in the conveying direction 16. The platen 42 is opposed to the recording device 24 so as to support a lower surface of the sheet 12 conveyed through the conveyance path 65. Formed on an upper surface of the platen 42 are a plurality of support ribs 52 projecting upward and extending in the front and rear direction 8. The support ribs 52 are spaced apart from each other in the right and left direction 9 at predetermined distances. The sheet 12 conveyed in the conveyance path 65 is supported by the platen 42, specifically, by projecting edges 53 of the respective support ribs 52 formed on the upper surface of the platen 42. The support ribs 52 are one example of a plurality of second contact portions, and the projecting edges 53 are one example of a plurality of contact edges.

Recording Device 24

As illustrated in FIGS. 2 and 4, the recording device 24 is provided in an upper portion of the conveyance path 65 at a position between the conveying roller portion 54 and the output roller portion 55 in the conveying direction 16. The recording device 24 is opposed to the platen 42. The recording device 24 includes: a carriage 23 movable along guide rails 43, 44 in the right and left direction 9, i.e., a main scanning direction; the recording head 39 mounted on the carriage 23; and nozzles 40 formed in a lower face of the recording head 39. The guide rails 43, 44 extend in the right and left direction 9 and are spaced apart from each other in the front and rear direction 8. The guide rail 43, 44 are assembled to the frame 41 (see FIG. 5) which supports components such as the conveying roller 60 and the platen 42.

Figure 10:
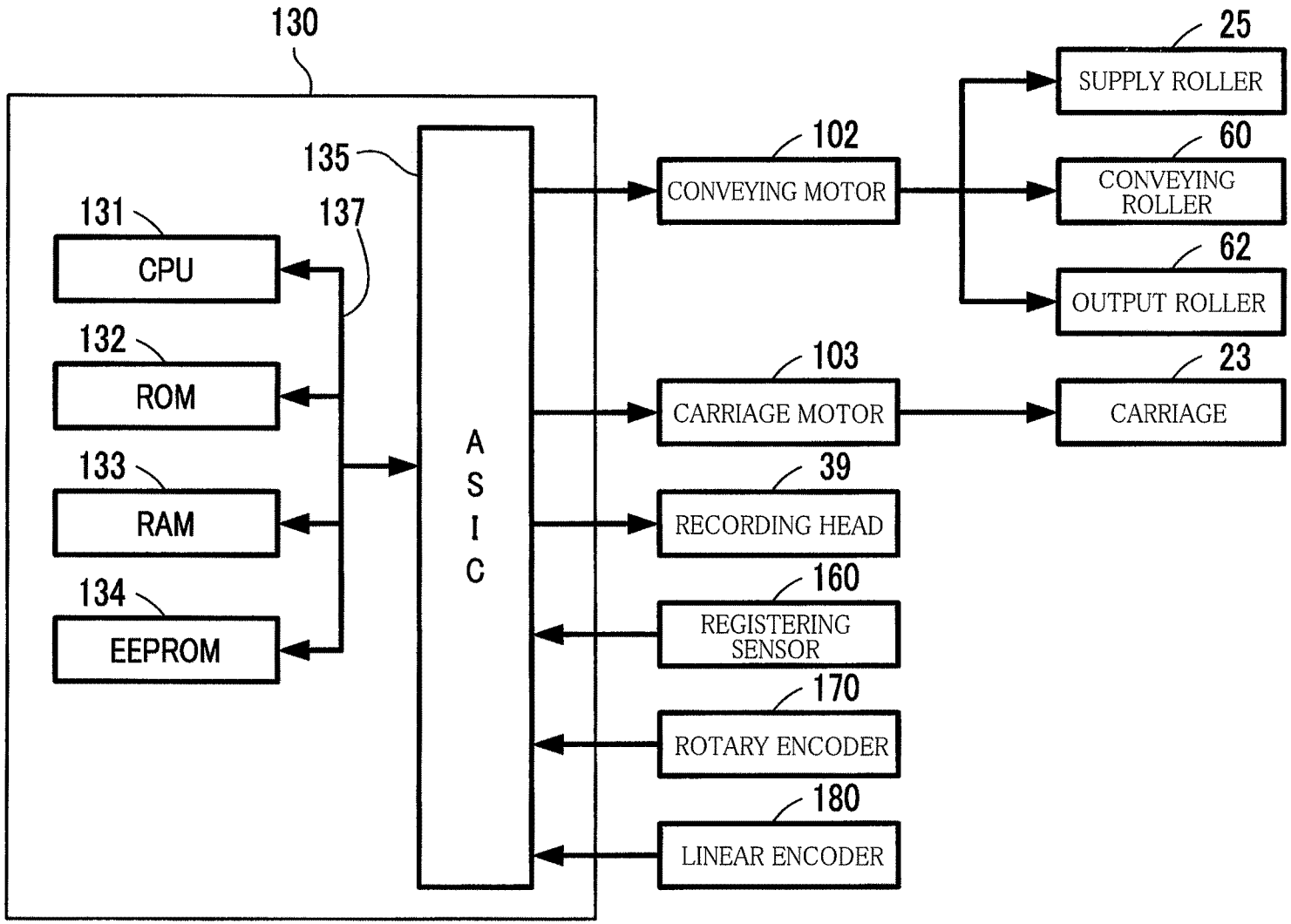
FIG. 10 is a block diagram illustrating a controller of the MFP.

The carriage 23 is moved in the right and left direction 9 by drive power transmitted from a carriage motor 103 (see FIG. 10). A direction of movement of the carriage 23 is switched by switching of a rotational direction of the carriage motor 103, for example. The nozzles 40 are openings from which the recording head 39 ejects fine droplets of ink supplied from an ink cartridge, not shown. While the carriage 23 is being moved in the right and left direction 9, the recording device 24 ejects ink droplets selectively from the nozzles 40 onto the sheet 12 supported on the platen 42. As a result, an image is recorded on the sheet 12.

Registering Sensor 160

Figure 5:
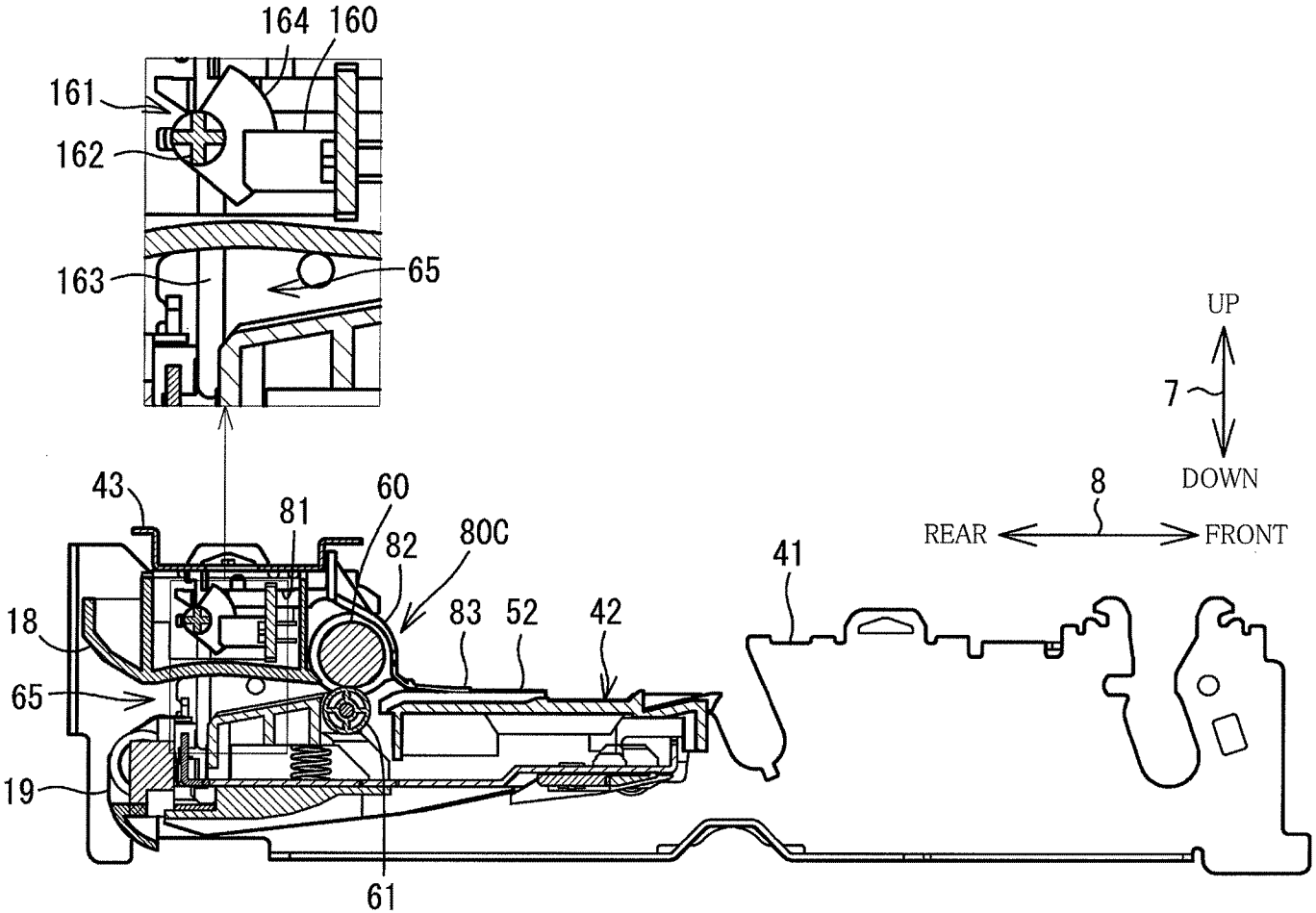
FIG. 5 is an elevational view in vertical cross section illustrating components around a registering sensor and a detecting lever.
Figure 6:
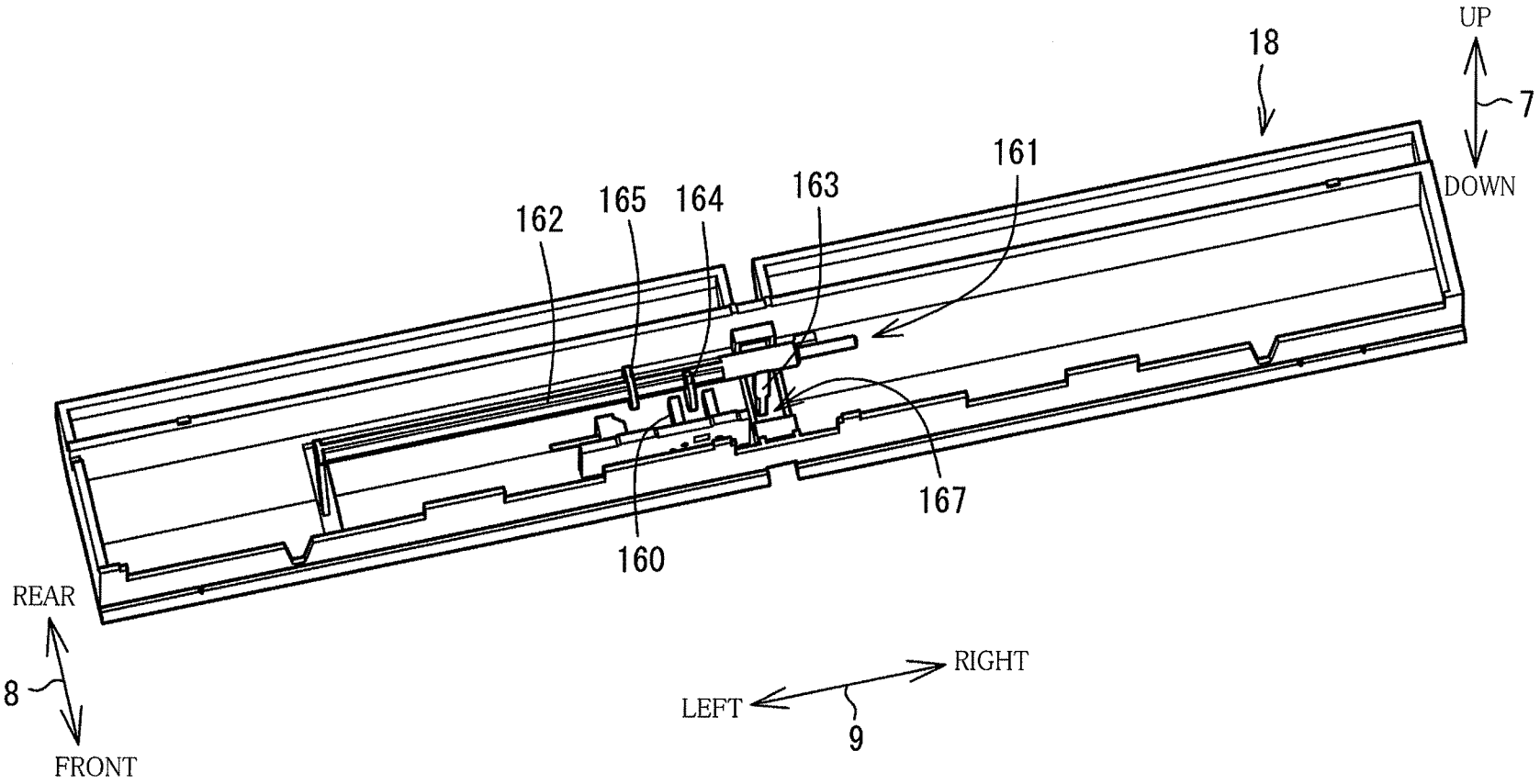
FIG. 6 is a perspective view illustrating an outer guide member supporting the registering sensor and the detecting lever.

As illustrated in FIGS. 2, 5, and 6, a registering sensor 160 and a detecting lever 161 are provided in the conveyance path 65 at a position located upstream of the conveying roller portion 54 in the conveying direction 16. The detecting lever 161 includes: a rotation shaft 162 rotatably supported by the outer guide member 18; and an arm 163 and a detecting element 164 each projecting from the rotation shaft 162.

As illustrated in FIG. 6, a rib 165 is provided on an upper face of the outer guide member 18 (i.e., a face of the outer guide member 18 which is opposite a face thereof defining the conveyance path 65) at a position spaced apart from the detecting lever 161 in the right and left direction 9. The rotation shaft 162 of the detecting lever 161 is inserted in a hole of the rib 165 in the right and left direction 9, so that the rotation shaft 162 is rotatably supported. The outer guide member 18 supporting the detecting lever 161 is supported by the guide rail 43.

A hole 167 is formed in the outer guide member 18 at its center in the right and left direction 9, and the hole 167 extends through a wall of the outer guide member 18 which defines the conveyance path 65. The arm 163 is inserted into the hole 167 so as to project into the conveyance path 65 toward the inner guide member 19. The hole 167 is elongated in the front and rear direction 8 so as not to interfere with the arm 163 within an area in which the arm 163 is pushed and turned by the sheet 12 conveyed in the conveyance path 65.

The detecting element 164 projects from the rotation shaft 162 at a position that differs in the right and left direction 9 from a position at which the arm 163 projects from the rotation shaft 162. The length of the projecting portion of the detecting element 164 from the rotation shaft 12 is set such that the detecting element 164 does not interfere with the outer guide member 18 even when the rotation shaft 162 is rotated. Also, the position of the arm 163 in the right and left direction 9 is aligned with the center of the sheet 12 in the right and left direction 9 in the state in which the sheet 12 is placed on the bottom plate 91 of the supply tray 20.

The registering sensor 160 is disposed on the outer guide member 18 at a position corresponding to the detecting element 164. Thus, the registering sensor 160 is disposed at a position that differs from the position of the arm 163 in the right and left direction 9. The registering sensor 160 is an optical sensor including a light emitting element and a light receiving element opposed to each other. The registering sensor 160 outputs one of electric signals of different levels based on whether or not a light emitted from the light emitting element to the light receiving element is intercepted or attenuated by the detecting element 164. Specifically, the registering sensor 160 outputs a low level signal to a controller 130 (see FIG. 10) when the light emitted from the light emitting element is being intercepted by the detecting element 164, and the registering sensor 160 outputs a high level signal to the controller 130 when the light emitted from the light emitting element is not being intercepted by the detecting element 164. Since the detecting element 164 is rotated in conjunction with the arm 163 turned by the sheet 12, the signal transmitted from the registering sensor 160 allows the controller 130 to determine whether the sheet 12 is turning the arm 163 or not, that is, the signal allows the controller 130 to determine whether the sheet 12 is present at the position of the arm 163 in the conveyance path 65 or not.

Rotary Encoder 170

As illustrated in FIG. 4, a rotary encoder 170 is provided on one end portion of the conveying roller 60. The rotary encoder 170 includes an encoder disc 171 and an optical sensor 172. The encoder disc 171 is fixed to the one end portion of the conveying roller 60 and rotated by the rotation of the conveying roller 60. The encoder disc 171 includes light interceptors shaped like a thin and flap disc having light transparency, and the light interceptors extend in its radial direction and spaced apart from each other in its circumferential direction. The optical sensor 172 is disposed such that the light interceptors of the encoder disc 171 can pass through a position between the light emitting element and the light receiving element. The optical sensor 172 outputs a pulse signal to the controller 130 based on a change in light detected by the light interceptors which are rotated by the rotation of the encoder disc 171 so as to pass through the position between the light emitting element and the light receiving element.

Linear Encoder 180

As illustrated in FIG. 4, the guide rail 43 is provided with a strip-shaped encoder strip 45 extending in the right and left direction 9. The encoder strip 45 includes light transmitting portions and light intercepting portions which are alternately arranged in the longitudinal direction of the encoder strip 45. As illustrated in FIG. 2, an optical sensor 38 is mounted on the carriage 23. The optical sensor 38 includes a light emitting element and a light receiving element arranged with the encoder strip 45 located therebetween. While the carriage 23 is being moved in the right and left direction 9, the optical sensor 38 outputs a pulse signal based on a change in light transmitted through the light transmitting portions of the encoder strip 45 and received by the light receiving element. A linear encoder 180 illustrated in FIG. 10 is constituted by the optical sensor 38 and the encoder strip 45.

Contact Members 80

Figure 7:
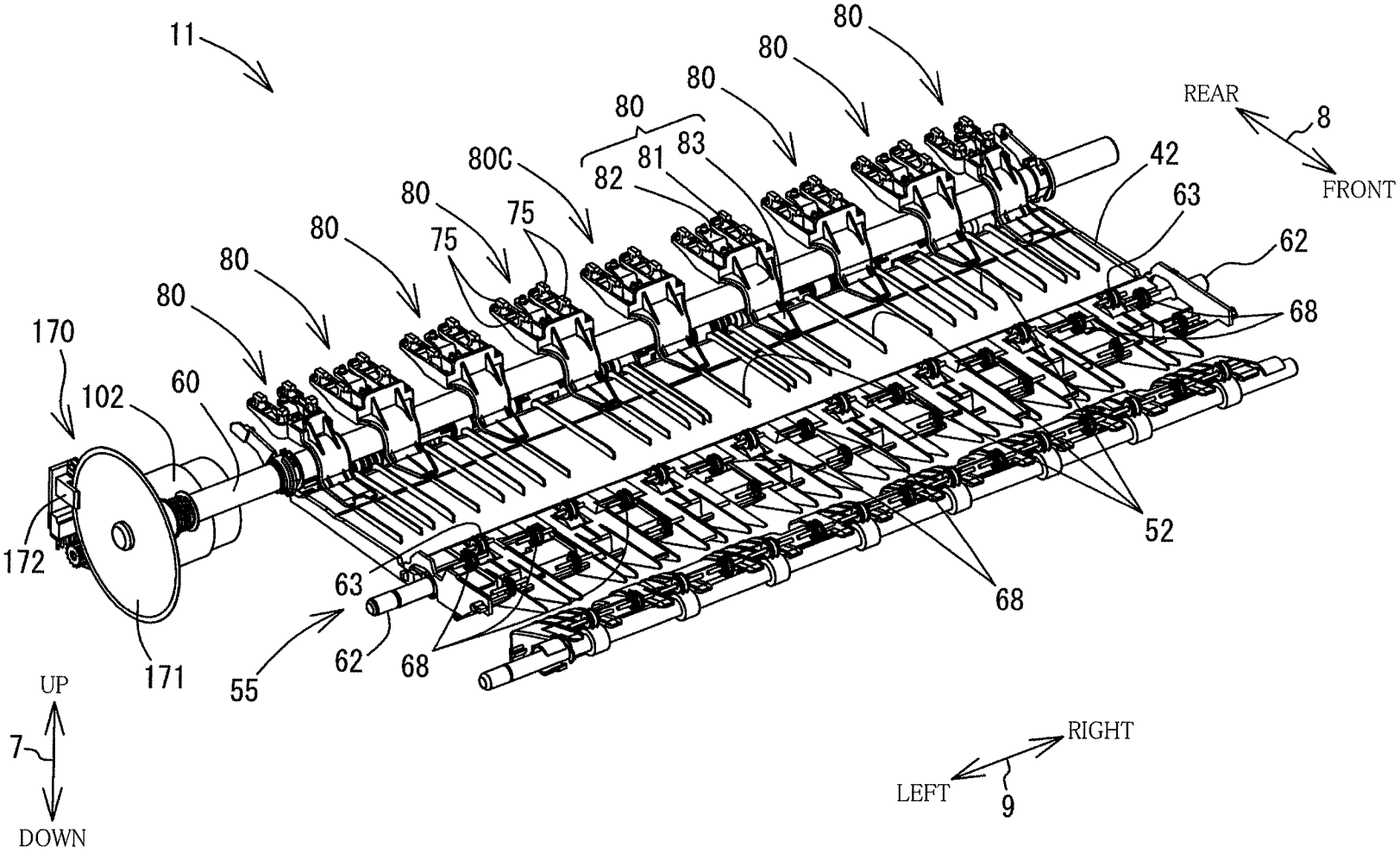
FIG. 7 is a perspective view illustrating contact members and a platen.
Figure 8:
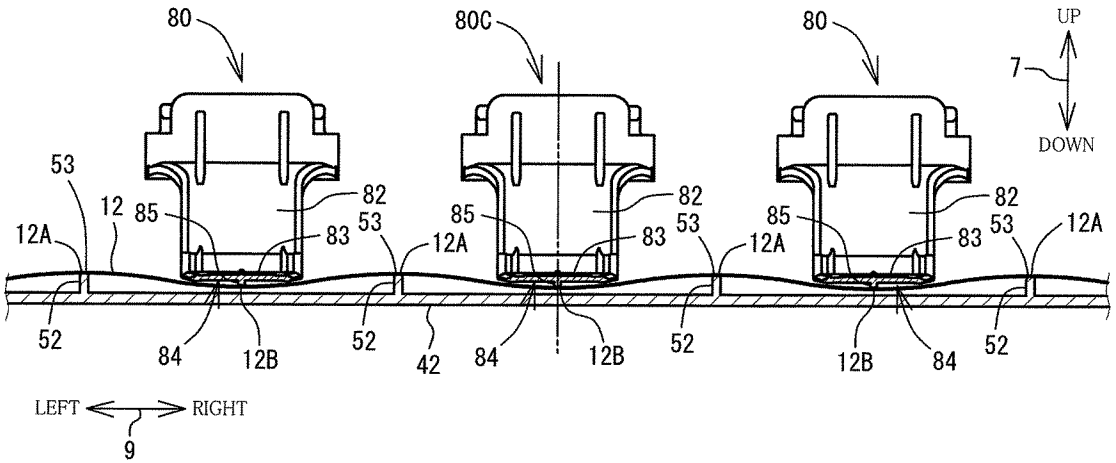
FIG. 8 is a cross-sectional view illustrating a positional relationship between support ribs formed on the platen and contact ribs of the respective contact members.
Figure 9:
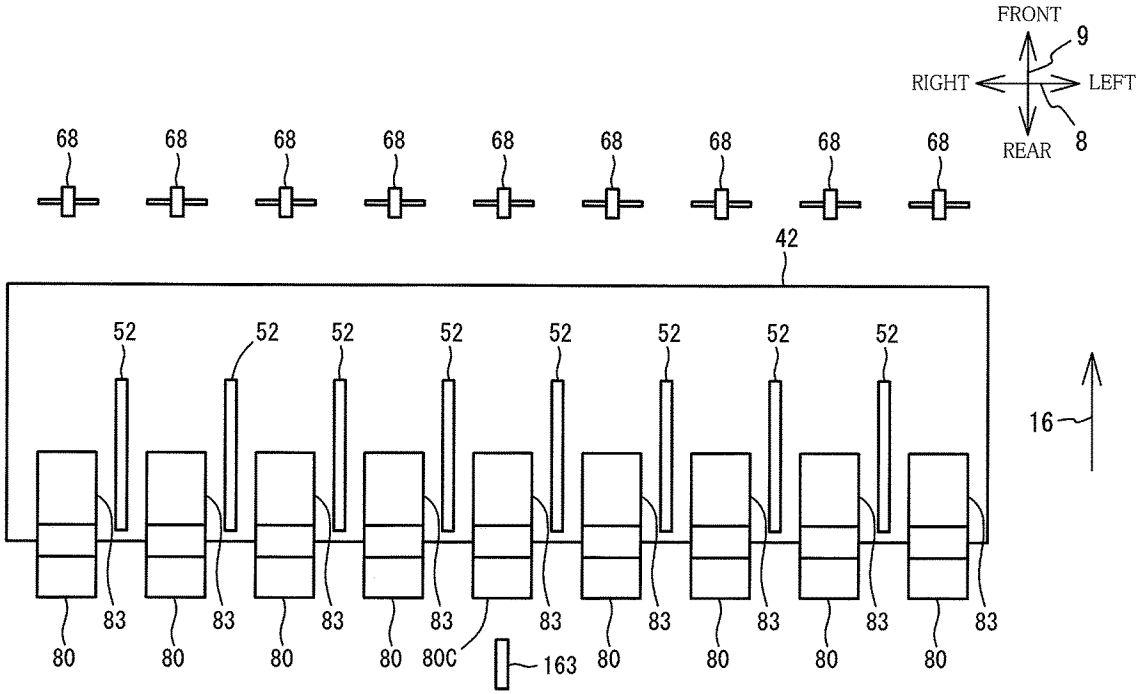
FIG. 9 is a schematic view illustrating a positional relationship among the arm of the registering sensor, the contact members, and corrugating spurs.

As illustrated in FIGS. 2, 4, and 7, contact members 80 are provided in the conveyance path 65 at a position located upstream of the recording head 39 in the conveying direction 16. The contact members 80 are provided respectively at positions spaced apart from each other in the right and left direction 9. As illustrated in FIGS. 8 and 9, the contact members 80 are arranged at the respective positions different from each other in the right and left direction 9 so as to match a wavy shape to be formed on the sheet 12, and the contact members 80 include a contact member 80C located at a center in the right and left direction 9. That is, the arm 163 of the detecting lever 161 overlaps the position of the central contact member 80C in the right and left direction 9. Each of the contact members 80 is constituted by a fixing portion 81, a curved portion 82, and a contact portion 83. The contact portions 83 are one example of a plurality of first contact portions.

Each of the fixing portions 81 is generally shaped like a plate. The contact members 80 are fixed to the guide rail 43 by the respective fixing portions 81. A plurality of engaging portions 75 project from upper surfaces of the respective fixing portions 81. The engaging portions 75 are engaged respectively with edges of openings 74 formed in the guide rail 43, whereby the contact members 80 are secured to a lower face of the guide rail 43.

The curved portions 82 are curved from the respective fixing portions 81 frontward (i.e., toward a downstream side in the conveying direction 16) and downward. the contact portions 83 are provided on distal end portions of the respective curved portions 82 so as to project therefrom generally in the conveying direction 16.

Each of the contact portions 83 is generally shaped like a plate and provided at a position opposed to the platen 42 in the up and down direction 7. The contact portions 83 are positioned between the recording head 39 and the platen 42 in a direction perpendicular to both of the conveying direction 16 and the right and left direction 9 (in the present embodiment, the up and down direction 7). Contact ribs 85 are provided on lower faces 84 of the respective contact portions 83 so as to project downward. Lower edges of the contact ribs 85 are positioned so as to contact an upper surface of the sheet 12 supported by the platen 42. As a result, the sheet 12 is pressed downward (toward the platen 42) at positions 12B (see FIG. 8) by the contact portions 83. Distal edges of the respective contact ribs 85 (i.e., downstream edge portions thereof in the conveying direction 16) are located downstream of the conveying roller portion 54 in the conveying direction 16 and upstream of the nozzles 40 in the conveying direction 16.

As illustrated in FIG. 8, each one of the contact portions 83 is located between corresponding adjacent two of the support ribs 52 which are provided on the upper surface of the platen 42 so as to be spaced apart from each other in the right and left direction 9. In other words, each of the support ribs 52 projects toward the recording head 39 from a position between corresponding adjacent two of the contact members 80 in the right and left direction 9. That is, the contact ribs 85 and the support ribs 52 are arranged alternately in the right and left direction 9. The projecting edges 53 of the respective support ribs 52 are located above lower edges of the respective contact ribs 85, in other words, the projecting edges 53 of the respective support ribs 52 are located nearer to the recording head 39 than to the platen 42. Thus, the projecting edges 53 of the respective support ribs 52 respectively contact positions or areas 12A of the sheet 12 at positions nearer to the recording head 39 than the positions at which the contact ribs 85 contact the sheet 12.

The contact members 80 and the support ribs 52 shape the sheet 12 supported on the platen 42 into a series of regular folds that look like waves when viewed from the upstream or downstream side in the conveying direction 16.

Corrugating Spurs 68

As illustrated in FIGS. 2 and 7, corrugating spurs 68 are provided downstream of the output roller portion 55 in the conveying direction 16. The corrugating spurs 68 are spaced apart from each other in the right and left direction 9. The corrugating spurs 68 are arranged below the spurs 63 of the output roller portion 55 in the up and down direction 7. As a result, the corrugating spurs 68 contact the upper surface of the sheet 12.

As illustrated in FIG. 9, the corrugating spurs 68 are arranged generally at the same positions as the contact portions 83 of the respective contact members 80 in the right and left direction 9. In other words, each of the contact portions 83 and a corresponding one of the corrugating spurs 68 are arranged in a row in the front and rear direction 8. As a result, the contact portions 83 and the corrugating spurs 68 contact generally the same positions or areas on the sheet 12.

Wavy Shape of Sheet 12

At an area opposite the recording head 39 in the right and left direction 9, as illustrated in FIG. 8, the sheet 12 has a wavy shape in which the top positions or portions 12A and the bottom positions or portions 12B are arranged alternately in the right and left direction 9. Each of the top positions 12A is a position of a boundary at which a distance between the recording head 39 and the sheet 12 is changed from a decreasing trend to an increasing trend in the right and left direction 9. It is noted that the top positions 12A correspond generally to the positions of the projecting edges 53 of the respective support ribs 52 formed on the platen 42. Each of the bottom positions 12B is a position of a boundary at which the distance between the recording head 39 and the sheet 12 is changed from the increasing trend to the decreasing trend in the right and left direction 9. It is noted that the bottom positions 12B correspond generally to the positions of the contact ribs 85 of the contact members 80 and the corrugating spurs 68. Also, a portion of the sheet 12 between each top position 12A and the corresponding bottom position 12B adjacent to each other has a curved shape generally approximated by a cubic function.

In the present embodiment, the contact members 80 are provided at nine positions spaced apart from each other in the right and left direction 9. Accordingly, there are nine bottom positions 12B in the present embodiment. Also, in the present embodiment, two of the bottom positions 12B are respectively located on opposite edge portions of sheet 12 in the right and left direction 9 in order to prevent the opposite edge portions of sheet 12 in the right and left direction 9 from serving as free edges and contacting the recording head 39. That is, each of the top positions 12A is located between corresponding adjacent two of the bottom positions 12B. Thus, there are eight top positions 12A in the present embodiment. In the present embodiment, the central bottom position 12B in the right and left direction 9 (i.e., the fifth bottom position 12B from the edge of the sheet 12 in the right and left direction 9) is defined as a reference position. In general, this bottom position 12B is generally aligned with the center of the sheet 12 in the right and left direction 9. Accordingly, this bottom position 12B is generally aligned with the position of the arm 163 of the detecting lever 161.

Controller 130

As illustrated in FIG. 10, the controller 130 includes a CPU 131, a ROM 132, a RAM 133, an EEPROM 134, and an ASIC 135, which are connected to each other by an internal bus 137. The ROM 132 stores, e.g., programs to be used by the CPU 131 to control various operations. The RAM 133 is used as a working area for data processing or as a storage area for temporarily storing data, signals, and the like to be used by the CPU 131 to execute the above-described programs. The EEPROM 134 stores settings, flags, and the like to be kept also after the MFP 10 is turned off.

The conveying motor 102 and the carriage motor 103 are connected to the ASIC 135. The ASIC 135 acquires drive signals for rotating the motors, from the CPU 131 and sends the motors drive currents related to the drive signals. The motors are driven by the drive currents supplied from the ASIC 135. For example, the controller 130 controls the conveying motor 102 to rotate the rollers. The controller 130 controls the carriage motor 103 to reciprocate the carriage 23. The controller 130 controls the recording head 39 to eject the ink from the nozzles 40.

The registering sensor 160, the rotary encoder 170, and the linear encoder 180 are electrically connected to the ASIC 135. The controller 130 detects a position of the sheet 12 based on a sense signal output from the registering sensor 160 and a pulse signal output from the rotary encoder 170. The controller 130 detects a position of the carriage 23 based on the pulse signal acquired from the linear encoder 180.

Detection of Sheet 12 by Registering Sensor 160

A leading edge of the sheet 12 supplied from the supply tray 20 into the conveyance path 65 by the supply portion 15 is brought into contact with the arm 163 of the detecting lever 161 at the position located upstream of the conveying roller 60 in the conveying direction 16. When the sheet 12 is conveyed further in the conveying direction 16, the arm 163 is turned by the sheet 12, so that the arm 163 is moved from a first position (see FIG. 2) at which the arm 163 projects into the conveyance path 65 in a direction intersecting the conveying direction 16 to a second position (see FIG. 11) at which the arm 163 is retracted toward the outer guide member 18. This switch of the position of the arm 163 rotates the rotation shaft 162 with the detecting element 164. This rotation switches the light intercepting state of the detecting element 164, which switches the signal to be output from the registering sensor 160 from the low level signal to the high level signal. The controller 130 determines the position of the leading edge of the sheet 12 based on the timing of the switch of the signal to be output from the registering sensor 160 and an amount of rotation of the conveying roller 60 which is detected by the rotary encoder 170.

Likewise, when the sheet 12 is conveyed further in the conveying direction 16, a trailing edge of the sheet 12 is moved off the arm 163. As a result, the arm 163 is moved from the second position back to the first position, so that the signal to be output from the registering sensor 160 is switched from the high level signal to the low level signal. The controller 130 determines the position of the trailing edge of the sheet 12 based on the timing of the switch of the signal to be output from the registering sensor 160 and an amount of rotation of the conveying roller 60 which is detected by the rotary encoder 170.

Figure 11:
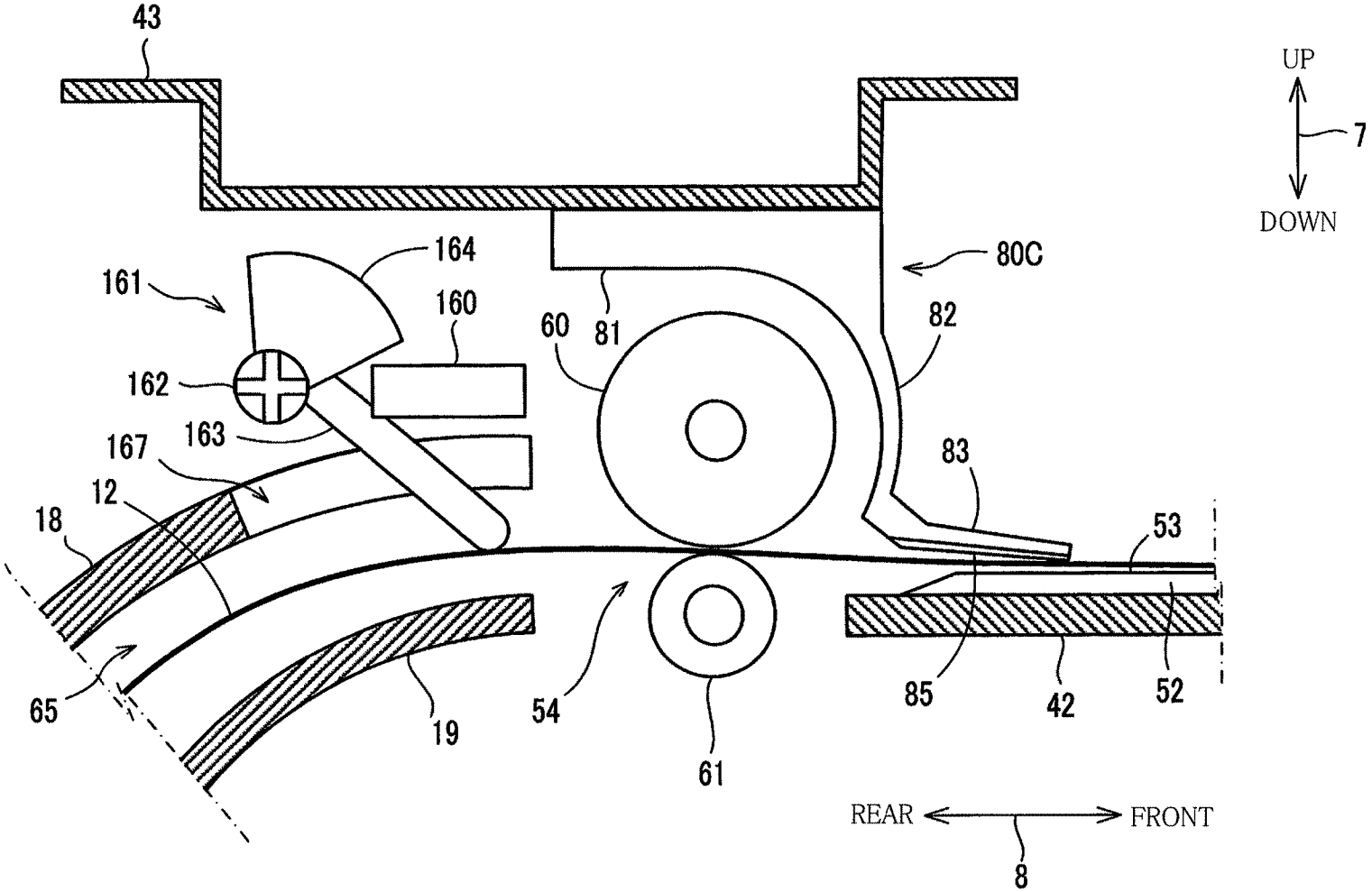
FIG. 11 is a schematic view illustrating components around the registering sensor and the detecting lever in a state in which a sheet is conveyed by a conveying roller portion.

As illustrated in FIG. 11, after turning the arm 163 from the first position to the second position, the sheet 12 is nipped between the conveying roller 60 and the pinch rollers 61 and conveyed onto the platen 42. On the platen 42, as described above, the sheet 12 is brought into contact with the contact ribs 85 of the contact members 80 and the projecting edges 53 of the respective support ribs 52 formed on the platen 42 and thereby formed into a wavy shape.

Since the arm 163 of the detecting lever 161 is held in contact with the upper surface of the sheet 12, a downward load is applied to the sheet 12 from the arm 163 at a position located upstream of the conveying roller 60 in the conveying direction 16. This load acts to move the sheet 12 upward on the platen 42, with the nipping position of the conveying roller 60 and the pinch rollers 61 serving as a fulcrum. Against this force, the contact rib 85 of the central contact member 80 in the right and left direction 9 is held in contact with the upper surface of the sheet 12 on the platen 42, preventing the sheet 12 from floating up from the support ribs 52 formed on the platen 42.

Effects of Embodiment

In the MFP 10 according to the present embodiment, the position of the arm 163 of the detecting lever 161 overlaps the position of the contact portions 83 of the respective contact members 80 in the right and left direction 9, preventing the sheet 12 from floating up from the support ribs 52 formed on the platen 42 even in the construction in which the detecting lever 161 is disposed in the portion of the conveyance path 65 nearer to the recording head 39.

In the MFP 10, the contact members 80 and the outer guide member 18 are supported by the guide rail 43, and the detecting lever 161 is supported by the outer guide member 18, whereby the contact members 80 and the detecting lever 161 are positioned with respect to the guide rail 43. This construction stabilizes the position at which the sheet 12 is brought into contact with the arm 163 of the detecting lever 161, thereby improving accuracy of detection of the sheet 12.

In the MFP 10, the registering sensor 160 is disposed on the outer guide member 18 at the position that differs from the position of the arm 163 in the right and left direction 9, resulting in a smaller space in which the registering sensor 160 and the detecting lever 161 are arranged.

Modifications

The MFP 10 according to the above-described embodiment uses what is called the center registration in which the center of the sheet 12 in the widthwise direction along the right and left direction 9 is aligned with the center of the supply tray 20 in the right and left direction 9. However, the MFP 10 uses what is called side registration in which one edge of the sheet 12 in the widthwise direction is aligned with a reference position located at one edge portion of the supply tray 20 in the right and left direction 9. In the configuration using the side registration, the arm 163 of the registering sensor 160 is disposed on one of opposite sides of the conveyance path 65 in the right and left direction 9 at such a position that the registering sensor 160 can detect the sheet 12 of the minimum size which can be used for the image recording of the MFP 10.

While the MFP 10 uses what is called a U-turn path as the conveyance path 65 in the above-described embodiment, the MFP 10 uses what is called a straight path in which the conveying direction 16 generally coincides with a fixed direction.

While one support rib 52 is disposed between each adjacent two of the contact members 80 in the MFP 10 according to the above-described embodiment, no support rib 52 may be disposed between adjacent two of some of the contact members 80. While the contact members 80 are provided independently of each other, the MFP 10 may be configured such that one fixing portion 81 is provided for the contact portions 83, and one contact member is provided so as to include the contact portions 83, for example.

What is claimed is:

1. An image recording apparatus, comprising:

a roller pair configured to nip and convey a sheet in a conveying direction along a conveyance path;

a recording head comprising a plurality of nozzles and configured to eject liquid from the plurality of nozzles;

a platen disposed opposite the recording head and configured to support the sheet conveyed by the roller pair;

a first guide member disposed upstream of a nip position, in the conveying direction, of the roller pair at which the roller pair nips the sheet and disposed on a recording-head side of the conveyance path to define at least a portion of one of opposite areas of the conveyance path;

a second guide member disposed upstream of the nip position of the roller pair in the conveying direction and disposed on a platen side of the conveyance path to define at least a portion of another of the opposite areas of the conveyance path;

a detecting lever provided rotatably and comprising an arm protruding from the first guide member toward the second guide member into the conveyance path;

a sensor configured to detect rotation of the detecting lever, and a plurality of first contact portions opposed to the platen so as to contact the sheet, the plurality of first contact portions being disposed such that the nip position of the roller pair is positioned between the arm of the detecting lever and the plurality of first contact portions in the conveying direction, the plurality of first contact portions being spaced apart from each other in a widthwise direction which intersects the conveying direction, the plurality of first contact portions each having a contacting range with the sheet in the widthwise direction;

wherein a position of the arm in the widthwise direction is included in the contacting range of a particular one of the plurality of first contact portions, and the arm is aligned with the particular one of the plurality of first contact portions as viewed in the conveying direction, and wherein each of the arm and the plurality of first contact portions is configured to contact with an upper surface of the sheet.

2. The image recording apparatus according to claim 1, wherein the detecting lever is turned when the arm is pushed by the sheet conveyed in the conveyance path.

3. The image recording apparatus according to claim 1, further comprising:

a rail extending in the widthwise direction; and a carriage supported by the rail and movable in the widthwise direction, wherein the recording head is mounted on the carriage, wherein the plurality of first contact portions and the first guide member are supported by the rail, and wherein the detecting lever is supported by the first guide member.

4. The image recording apparatus according to claim 3, wherein the sensor is supported by the first guide member and disposed at a position that differs from the position of the arm in the widthwise direction.

5. The image recording apparatus according to claim 1, further comprising a supply tray configured to support the sheet, wherein the supply tray is configured to support the sheet in a state in which a center of the sheet placed on the supply tray in the widthwise direction is aligned with a predetermined position, and wherein the position of the arm in the widthwise direction coincides with a position of the center of the sheet placed on the supply tray in the widthwise direction.

6. The image recording apparatus according to claim 1, wherein the conveyance path is curved such that the first guide member is disposed outside the conveyance path, and the second guide member is disposed inside the conveyance path.

7. The image recording apparatus according to claim 1, further comprising a plurality of second contact portions each disposed at least between corresponding adjacent two of the plurality of first contact portions in the widthwise direction, wherein the plurality of second contact portions are disposed in a platen-side portion of the conveyance path and disposed upstream, in the conveying direction, of the position of the plurality of nozzles, and wherein the plurality of first contact portions are configured to cooperate with the plurality of second contact portions to corrugate the sheet.

8. The image recording apparatus according to claim 7, wherein the plurality of second contact portions are disposed on the platen.

9. The image recording apparatus according to claim 7, wherein the plurality of second contact portions respectively comprise a plurality of contact edges configured to contact the sheet and located nearer to the recording head than positions at which the plurality of first contact portions contact the sheet.

10. The image recording apparatus according to claim 7, wherein, between each adjacent two of all the plurality of first contact portions, a corresponding one of the plurality of second contact portions is disposed.

11. An image recording apparatus, comprising:

a roller pair configured to nip and convey a sheet in a conveying direction along a conveyance path;

a recording head comprising a plurality of nozzles and configured to eject liquid from the plurality of nozzles onto the sheet conveyed by the roller pair;

a platen disposed opposite the recording head and configured to support the sheet conveyed by the roller pair;

a detecting lever provided rotatably and comprising an arm protruding from a recording-head side of the conveyance path toward a platen side of the conveyance path into the conveyance path;

a sensor configured to detect rotation of the detecting lever; and a plurality of first contact portions opposed to the platen so as to contact the sheet, the plurality of first contact portions being disposed such that the nip position of the roller pair is positioned between the arm of the detecting lever and the plurality of first contact portions in the conveying direction, the plurality of first contact portions being spaced apart from each other in a widthwise direction which intersects the conveying direction, the plurality of first contact portion each having a contacting range with the sheet in the widthwise direction;

wherein a position of the arm in the widthwise direction is included in the contacting range of a particular one of the plurality of first contact portions, and the arm is aligned with the particular one of the plurality of first contact portions as viewed in the conveying direction, and wherein each of the arm and the plurality of first contact portions is configured to contact with an upper surface of the sheet.

12. The image recording apparatus according to claim 1, wherein each of the arm and the particular one of the plurality of first contact portions is positioned at a center of the sheet in the widthwise direction.

13. The image recording apparatus according to claim 1, wherein a length of the particular one of the plurality of first contact portions in the widthwise direction is greater than a length of the arm in the widthwise direction.

* * * * *